US010773414B2

(12) United States Patent
Patel

(10) Patent No.: US 10,773,414 B2
(45) Date of Patent: Sep. 15, 2020

(54) SERVO CONTROLLED STITCHING APPARATUS AND METHOD THEREOF

(71) Applicant: Udaykumar Chhabildas Patel, Ahmedabad (IN)

(72) Inventor: Udaykumar Chhabildas Patel, Ahmedabad (IN)

( * ) Notice: Subject to any disclaimer, the term of this patent is extended or adjusted under 35 U.S.C. 154(b) by 0 days.

(21) Appl. No.: 16/348,205

(22) PCT Filed: Nov. 11, 2017

(86) PCT No.: PCT/IN2017/050523
§ 371 (c)(1),
(2) Date: May 8, 2019

(87) PCT Pub. No.: WO2018/087783
PCT Pub. Date: May 17, 2018

(65) Prior Publication Data

US 2019/0321998 A1 Oct. 24, 2019

(30) Foreign Application Priority Data

Nov. 12, 2016 (IN) ..... 201621038717

(51) Int. Cl.
*B27F 7/23* (2006.01)
*B42B 4/02* (2006.01)
*B27F 7/17* (2006.01)

(52) U.S. Cl.
CPC ..... *B27F 7/23* (2013.01); *B27F 7/17* (2013.01); *B42B 4/02* (2013.01)

(58) Field of Classification Search
CPC ..... B42B 4/02; B27F 7/17; B27F 7/23
USPC ..... 270/37, 58.18, 58.08
See application file for complete search history.

(56) References Cited

U.S. PATENT DOCUMENTS 2,839,753 A 6/1958 Reed et al.
4,328,919 A 5/1982 Lawrence et al.
4,356,947 A * 11/1982 Marshall ..... B25C 5/08 227/152
4,358,042 A * 11/1982 Lawrence ..... B27F 7/19 227/152

(Continued)

FOREIGN PATENT DOCUMENTS

JP H04299193 A 10/1992

OTHER PUBLICATIONS

English Abstract for JP H04299193 A (1992).

*Primary Examiner* — Leslie A Nicholson, III
(74) *Attorney, Agent, or Firm* — Caesar Rivise, PC

(57) ABSTRACT

The present invention relates to a servo controlled stitching apparatus that comprises a servo controlled wire pulling means (4) for pulling the required length of wire for stitching bunch of paper sheets. Said pulling means (4) comprises pulling roller (11) having wire retaining groove (11*a*) for guiding wire extending from the spool (2) towards the stitching head (1). It also comprises pressure roller (13) that rotates against pulling roller (11) for pulling the wire (16) from the spool (2). The length of wire to be pulled is predefined in the controller means which is communicated with the servo motor (7) that rotates said rollers (11, 13) until the predetermined length of wire is pulled. The stitching head (1) utilize the wire (16) of pulled length without rotating the spool itself to avoid pulling load and to apply even stapling on the bunch of paper sheets.

2 Claims, 4 Drawing Sheets

(56) References Cited

U.S. PATENT DOCUMENTS

| | | | | | |
|---|---|---|---|---|---|
| 4,389,011 | A * | 6/1983 | Lovibond | B25C 5/08 | 227/5 |
| 4,416,046 | A * | 11/1983 | Stokes | B25C 5/08 | 29/417 |
| 4,444,347 | A * | 4/1984 | Males | B27F 7/21 | 227/88 |
| 4,537,342 | A * | 8/1985 | McCain | B42B 4/00 | 227/156 |
| 4,546,910 | A * | 10/1985 | Logtens | B42B 4/00 | 140/93 D |
| 5,690,265 | A * | 11/1997 | Jakob | B27F 7/19 | 227/155 |
| 5,788,139 | A * | 8/1998 | Sikora | B27F 7/28 | 227/82 |
| 7,537,144 | B1 * | 5/2009 | Marcinik | B65H 49/18 | 227/1 |

* cited by examiner

SERVO CONTROLLED STITCHING APPARATUS AND METHOD THEREOF

FIELD OF THE INVENTION

The present invention relates to a stitching apparatus for stitching bunch of paper sheets to form a magazines, booklets, notebooks and similar products and more particularly it relates to a servo controlled stitching apparatus for pulling predefined length of wire from the spool for avoiding the pulling load on the stitching head and applying said pulled wire with accurate and even stapling on the sheets.

BACKGROUND AND PRIOR ART OF THE INVENTION

Wire stitching apparatus are employed in book binding machine for stapling bunch of paper sheets to form a note books etc. One such conventional wire stitching machine is shown in FIG. 1. According to FIG. 1, conventional stitching machine includes the stitching head (1) that reels out a wire from the wire spool (2) and then cuts the wire (W) in a predetermined length, bends the wire into a U-shaped and drives the U-shaped wire into the set of sheets. Simultaneously when the wire (W) is driven, both ends of the U-shaped wire passed through the set of sheets are bent to staples the set of sheets.

One such wire stitcher for binding sets of sheets has been disclosed in the U.S. Pat. No. 4,328,919 that comprises a stitcher head having wire advancing and cutting mechanism for pulling the length of wire from the spool and applying on the paper sheets to be stitched.

However, the above set up of stitching mechanism carry difficulties leading to improper stapling of the product. In this conventional stitching machine, the stitching wire is directly pulled by the stitching head from the spool that leads towards the improper feeding of wire from the spool. Hence, the problem of uneven length of stitching pin which deteriorates the quality of product is arisen. In such machines, the stitching head is permitted to freely pull the wire from the reel with the result that the reel has unrestrained rotation in the direction of the unreeling of the wire, and this has been found to be objectionable in that the unreeled wire is too loose and is apt to become tangled or kinked, with the result that the staples formed are uneven or are improperly applied to the paper sheets. Hence, when the wire spool is fully loaded with wire, then in such situation, stitching head require more load to pull the wire due to more weight. This result in small length of pins due to slippage and also affect the life span of the stitching head due to overload. Adversely, when the spool weight is reduced, excessive length of wire is pulled out that result into the more length of pin.

OBJECT OF THE INVENTION

The main object of present invention is to provide a servo controlled stitching apparatus that avoids the disadvantages of conventional stitching machine while affording additional structural and operating advantages.

Another object of present invention is to provide a servo controlled stitching apparatus which is efficient, fast, and accurate in operation.

Further object of present invention is to provide a servo controlled stitching apparatus having wire pulling mechanism for reeling out required length of the wire for the stitching operation and for providing proper pining tension.

Yet another object of present invention is to provide a servo controlled stitching apparatus that enables the stitching head to utilize pulled wire to avoid pulling load on the stitching head and thereby enhances the life span thereof.

Yet another object of present invention is to provide a servo controlled stitching apparatus that furnish consistent length of the pin for proper and even stitching.

One more object of present invention is to provide a servo controlled stitching apparatus having a provision for changing the length of wire to be pulled according to the thickness of the paper sheets to be stitched.

SUMMARY OF THE INVENTION

The present invention relates to a servo controlled stitching apparatus that comprises plurality of wire retaining spool, a servo controlled wire pulling means for pulling the required length of wire from the spool and plurality of stitching head for cutting and applying pulled wire for stitching the bunch of paper sheets. Said wire pulling means comprises plurality of pulling roller each having wire retaining groove for guiding wire extending from the respective spools towards the respective stitching head. It also comprises a plurality of pressure roller that rotates against pulling roller for positive pulling of wire from the spool. The length of wire to be pulled is predefined in the controller means which is communicated with the servo motor that rotates said rollers until the predetermined length of wire is pulled. The stitching head utilize the wire of pulled length without rotating the spool to avoid pulling load and to apply even stapling on the bunch of paper sheets.

BRIEF DESCRIPTION OF THE DRAWINGS

Further objects, advantages and features of the apparatus according to the invention will be apparent to those skilled in the art from the following detailed description of a particular embodiment, given by say of a non-limiting example, with reference to the accompanying drawings, wherein.

DETAIL DESCRIPTION OF THE INVENTION

Figure 1:
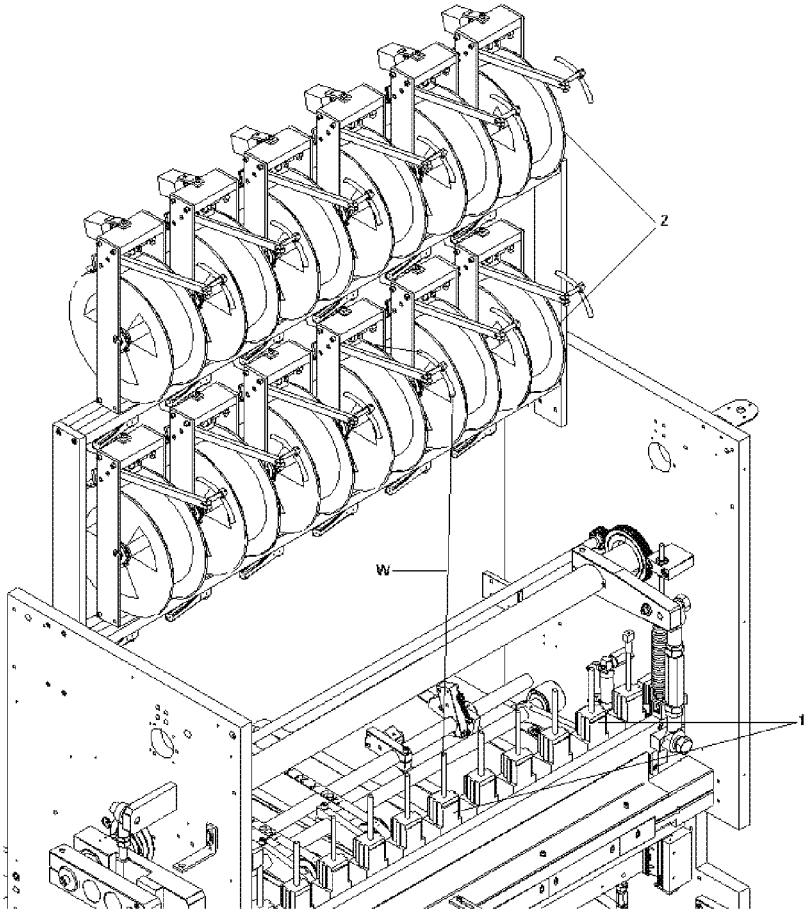
FIG. 1 shows a perspective view of the conventional wire stitching apparatus.

Before explaining the present invention in detail, it is to be understood that the invention is not limited in its application to the details of the construction and arrangement of parts illustrated in the accompany drawings. The invention is capable of other embodiments, as depicted in different figures as described above and of being practiced or carried out in a variety of ways. It is to be understood that the phraseology and terminology employed herein is for the purpose of description and not of limitation.

Before explaining the present invention, it is to be noted that the stitching apparatus according to present invention is described herein by implying that said apparatus are installed in the reel to book binding machine. However, it is within the scope of present invention to utilize said apparatus independently. It is to be also noted that, in the drawing, identical reference number identify similar element and acts.

Figure 2:
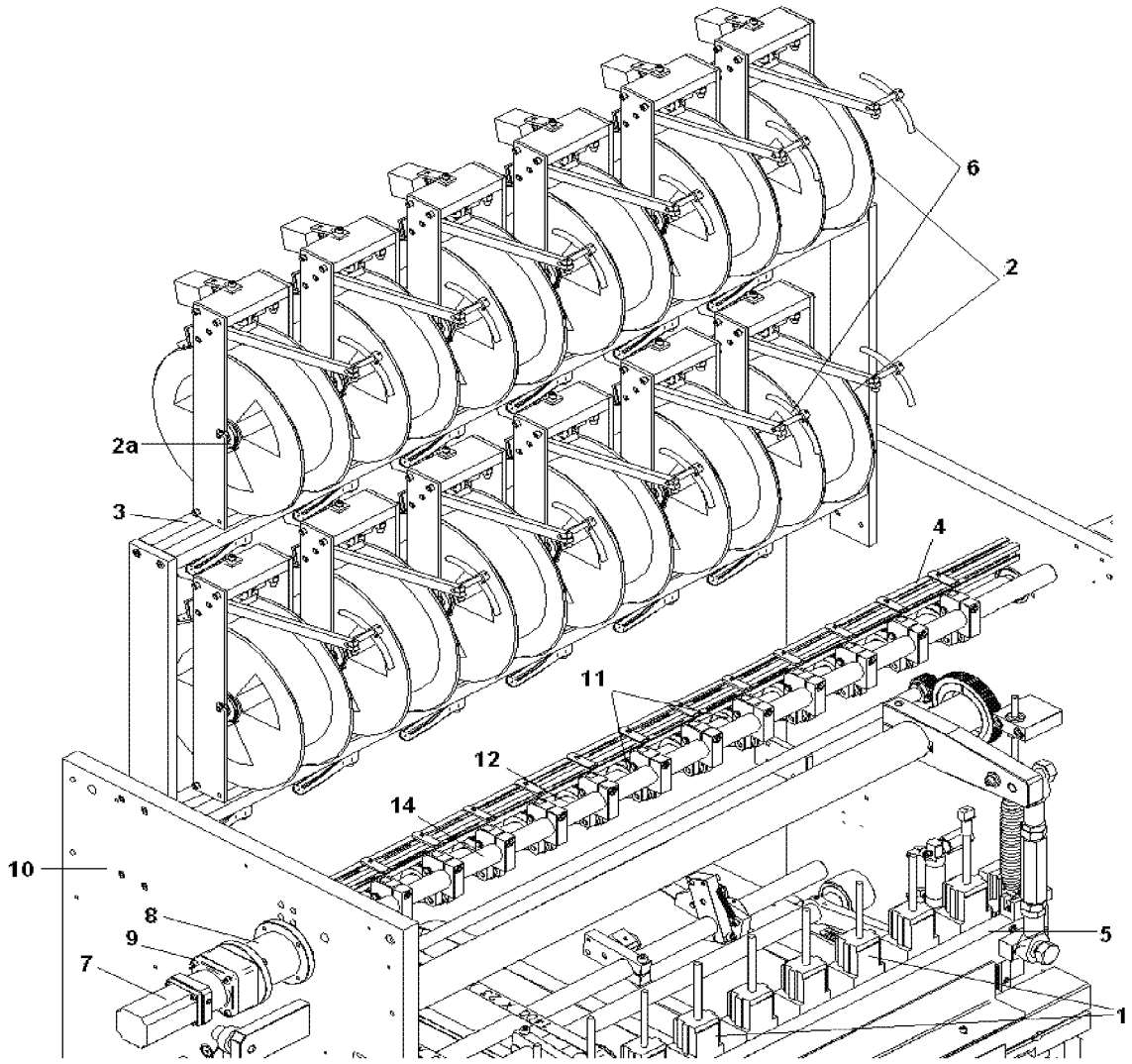
FIG. 2 shows a perspective view of servo controlled stitching apparatus in non-operating condition according to present invention.

Now as illustrated in FIG. 2, the servo controlled stitching apparatus according to present invention comprises a top frame (3), a servo controlled wire pulling means (4) disposed below said frame (3) and a lower platform (5) located below the pulling means (4) that receives the bunch of paper sheets to be stitched by conveying means (not shown).

Figure 4:
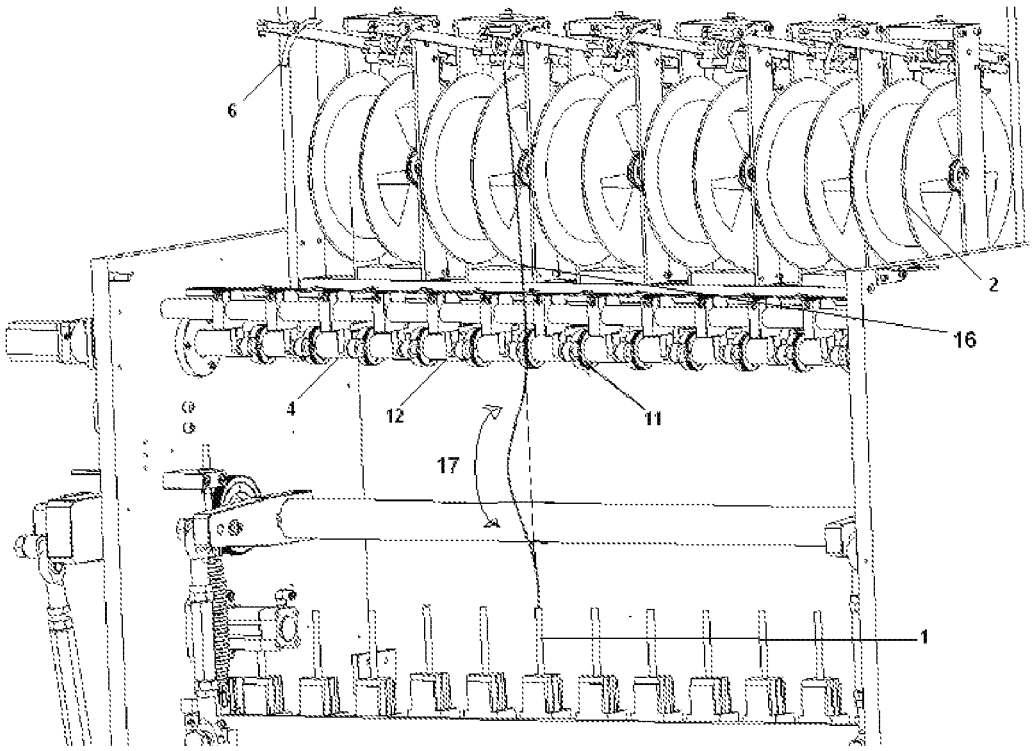
FIG. 4 shows a perspective view of servo controlled stitching apparatus in operating condition according to present invention.

Referring continuous with FIG. 2, said top frame (3) comprises a plurality of linearly arranged rotatable wire retaining spools (2) whereon stapling material (16), for example, wire (shown in FIG. 4), is wound. Said spools (2) are rotated with respect to an elongated spindle (2*a*) being longitudinally and centrally extended through the spools (2) when the wire (16) is pulled. In said embodiment, for the sake of understanding, only one wire is shown extending from the spool (2) as shown in FIG. 4. Practically, said wires (16) are fed vertically and parallely downward from respective spools (2) by passing through their corresponding guide channel (6).

Figure 3A:
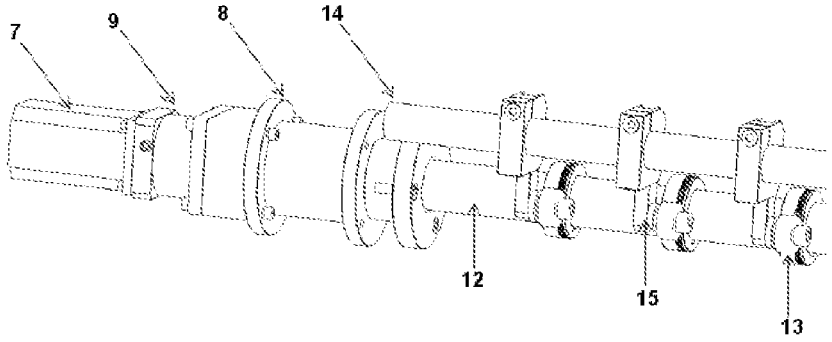
FIG. 3 depicts a perspective view of the servo controlled wire pulling means for pulling wire according to present invention.
Figure 3B:
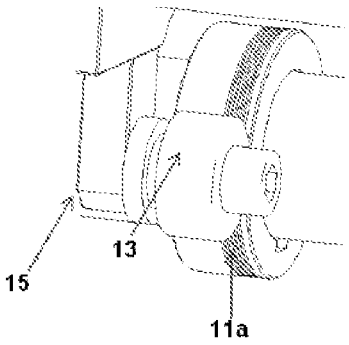
Figure 3C:
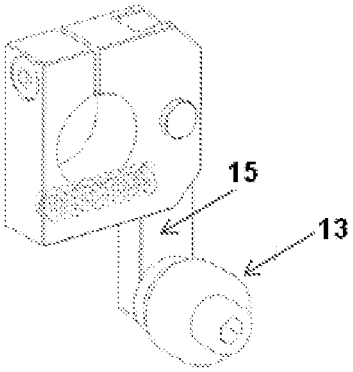

FIGS. 3*a*, 3*b* and 3*c* shows the servo controlled wire pulling means (4) in greater details. Now as shown in FIG. 3*a*, said servo controlled wire pulling means (4) comprises a programmable servo motor (7) being connected to a gearbox (8) through any conventional coupler (9) for controlling the speed of the servo motor (7) and located at either side of plate (10) as shown in FIG. 2, a plurality of wire pulling rollers (11) being rotatably and longitudinally located on a common shaft (12) (shown in FIG. 3*a*) drivably extended from the gearbox (8) and rotated through said servo motor (7). Each said pulling roller (11) comprises at least one circumferential wire receiving groove (11*a*) for guiding wire (16) therethrough being extended downwardly from the respective spool (2).

Said wire pulling means (4) comprises a plurality of free turning pressure roller (13) operating against the respective wire pulling roller (11) and longitudinally and rotatably loaded on an elongated rod (14) extended parallely with respect to the shaft (12) shown in FIG. 3*a*. Said servo motor (7) is communicated with a controller means (not shown) i.e. PLC (programmable logic controller), HMI (Human Machine Interface) wherein required length of wire to be pulled for stitching operation is predefined and accordingly said servo motor (7) and thereby the pulling roller (11) is operated. Hence, according to the thickness of workpiece (bunch of paper sheets), the length of wire to be pulled is predetermined in the controller means by user and accordingly said wire (16) is pulled from the spool (2) by said wire pulling means (4).

Now, as shown in FIG. 3*b*, the groove (11*a*) of each pulling roller (11) is configured such that about half of diameter of said wire (16) received therein and remaining portion of diameter is projected therefrom and remains in positive contact with pressure roller (13) so that the wire (16) is guided by the groove (11*a*) in the pulling roller (11) and is held under the pressure roller (13). This groove (11*a*) allows the wire (16) to diametrically protrude out of the surface of the roller (11) so that the wire (16) remain in contact with the surface of the pressure roller (13) and thus be gripped between these rollers. Said pressure roller (13) is loaded with spring (15) (shown in FIG. 3*c*) that applies constant pressure on the section of wire (16) between the pulling roller (11) and the pressure roller (13). This configuration ensures the positive pulling of wire (16).

It is to be noted that, in present embodiment, only one roller (pulling roller) (11) is grooved. However, it is within the scope of present invention that the pressure roll (13) may also be grooved if it is desired to make the adjustment more sensitive. Further, it is within the scope of present invention to rotate said elongated rod (14) by said motor (7) instead of said shaft (12) to pull the wire (16).

Now as shown in FIG. 2, said lower platform (5) comprises a plurality of linearly arranged stitching heads (1) wherein wires (16) extended from the respective pulling rollers (11) are properly threaded therein (respective stitching head). Said stitching heads (1) are perpendicularly applied on the bunch of the paper sheets along the conveying path of the paper sheets. Said stitching head (1) comprises a staple-forming and driving mechanism for advancing said wire (16) therethrough along the longitudinal axis thereof and performing stapling operation upon the pulled wire received from respective wire pulling roller (11). The sheets to be stitched are positioned beneath each stitching head (1) wherein the wire is cut and then driven into the paper sheets for stapling.

It is to be noted that the number of spools, wire pulling rollers, pressure rollers and stitching heads are determined according to the number of product to be stitched. Though said stitching apparatus according to present invention is automated, it is within the scope of present invention to utilize the sensor element for detecting the presence of workpiece (paper sheets) for actuating stitching operation automatically.

Referring now to FIG. 4 of the drawings, the method for operating the servo controlled stitching apparatus according to present invention is described in detail. Initially the wire (16) is kept in uniform tension throughout its extension from the spool (2) to the stitching head (1) (wire (16) including shown in doted line). During working, as depicted in FIG. 4, when the bunch of the paper sheets is sensed to be positioned below the stitching head (1) by the sensor, said servo motor (7) is actuated that drives the wire pulling roller (11) to be rotated through the shaft (12) according to pulling length of wire predefined in the controller means. As the pulling roller (11) rotates, the pressure roller (13) rotates by applying pressure on the wire (16) whereby the required length of the wire (16) is pulled from the respective spool (2) to form a slacked portion (17). After forming slacked portion (17), said servo motor (7) stops to rotate the pulling roller (11) by controlling means.

By said configuration, the wire extended between the spool (2) and the pulling roller (11) is kept taut by said pressure roller (13) and predetermined length of wire (16) is pulled that forms the slacked portion (17) of wire (16). Said pulled wire (slacked portion) (17) will yield sufficient length of wire (16) to staple by said stitching head (1) without causing the spool to revolve at this moment. After forming slacked portion (17), said stitching head (1) pulls and applies said slacked portion (17) of wire (16) on the bunch of paper sheets. After completion of stitching operation, said wire (16) is tighten as initially and again pulled by the pulling means (4) for stitching the next bunch of paper sheets in the same manner as described above.

From forgoing description, it is seen that said stitching apparatus according to present invention enables the stitching head (1) to utilize only slacked portion (17) for stapling without pulling wire from the spool (2) itself. Thus, unlike conventional stitching apparatus, the stitching head (1) doesn't deal directly with the spool (2) for pulling the wire (16) that protects the stitching head (1) from the pulling load. Further, said configuration according to present invention compels the stitching head (1) to utilize only slacked portion (17) of the wire (16) that maintain the quality of stapling in each cycle thereby the difficulties like short length and excessive length of pinning are overcame.

The invention has been explained in relation to specific embodiment. It is inferred that the foregoing description is only illustrative of the present invention and it is not intended that the invention be limited or restrictive thereto. Many other specific embodiments of the present invention will be apparent to one skilled in the art from the foregoing disclosure. All substitution, alterations and modification of the present invention which come within the scope of the following claims are to which the present invention is readily susceptible without departing from the spirit of the invention. The scope of the invention should therefore be determined not with reference to the above description but should be determined with reference to appended claims along with full scope of equivalents to which such claims are entitled.

LIST OF REFERENCE NUMERALS

Stitching Head (1)
Wire Retaining Spools (2)
Spindle (2*a*)
Top Frame (3)
Servo Controlled Wire Pulling Means (4)
Lower Platform (5)
Guide Channel (6)
Servo Motor (7)
Gearbox (8)
Conventional Coupler (9)
Plate (10)
Wire Pulling Rollers (11)
Wire Receiving Groove (11*a*)
Common Shaft (12)
Pressure Roller (13)
Elongated Rod (14)
Spring (15)
Wire (16)
Slacked Portion (17)

I claim:

1. A servo controlled stitching apparatus comprising:

at least one wire retaining spool;

at least one stitching head;

means for said at least one stitching head for feeding a wire delivered to it from said at least one wire retaining spool and for cutting a pulled wire into a desired section and for applying a cut section to a successive bunch of paper sheets for stitching;

wire pulling means in a path of the wire being delivered from said at least one wire retaining spool to the at least one stitching head for pulling the wire from the at least one wire retaining spool to form a slacked portion;

wherein said slacked portion defines a length of wire being pulled by said wire pulling means;

wherein said wire pulling means comprises a pair of rollers in closest proximity at their periphery rotatably mounted on shafts which are substantially parallel, means for rotating one of said shafts, means for applying pressure across the section of wire located between said rollers and a controller means wherein said slacked portion changeably defined is communicated with rotating means;

wherein one of said rollers is formed with at least one groove along its circular periphery for protrusively locating and guiding said wire;

wherein said wire is pulled by passing between said rollers while pressure is applied between diametrically opposed points on a periphery of said wire;

wherein said rotating means rotates any of said rollers slacked wire defined in the controller means is pulled from the spool.

2. A method for operating a servo controlled stitching apparatus according to claim 1, said method comprising the following steps:

a) delivering the wire from the at least one wire retaining spool to the at least one stitching head by extending between the rollers;

b) protrusively and diametrically guiding said wire from the groove formed on the periphery of any of said rollers;

c) defining a length of the slacked portion of wire in the controller means;

d) pulling said wire by rotating said rollers by the rotating means until the slacked portion of wire is formed;

e) stopping the rotating of said rollers;

f) applying said slacked portion of wire for stitching on a bunch of paper sheets by a stitching head;

g) performing steps a) to f) for stitching a next bunch of paper sheets.

* * * * *